US005245128A

United States Patent [19]

Araiza

[11] Patent Number: 5,245,128

[45] Date of Patent: Sep. 14, 1993

[54] CONTROLLER FOR A MUSICAL EFFECTS UNIT

[76] Inventor: Steven P. Araiza, 1772 Summerville Ave., Tustin, Calif. 92680

[21] Appl. No.: 816,965

[22] Filed: Jan. 3, 1992

[51] Int. Cl.[5] ..... G10H 1/00; G10H 3/18

[52] U.S. Cl. ..... 84/626; 84/477 R; 84/645; 84/647; 84/737; 84/646

[58] Field of Search ..... 84/626, 644, 645, 646, 84/647, 662, 670, DIG. 30, 477 R, 737, 742

[56] References Cited

U.S. PATENT DOCUMENTS 4,184,400 1/1980 Niimi .
4,305,320 12/1981 Peavey .
4,580,479 4/1986 Bonanno .
4,702,141 10/1987 Bonanno .
4,748,887 6/1988 Marshall .
4,777,857 10/1988 Stewart .
4,817,484 4/1989 Iba et al. .
4,998,457 3/1991 Suzuki et al. ..... 84/644
5,029,510 7/1991 Elion .

*Primary Examiner*—William M. Shoop, Jr.
*Assistant Examiner*—Helen Kim
*Attorney, Agent, or Firm*—Hawes & Fischer

[57] ABSTRACT

A controller for a musical effects unit enables control of an effects unit through the use of two touch buttons mounted on a guitar, or other instrument. The two touch switches form an input to a microprocessor utilizing control software to interpret the sequential contacting of the buttons. The software converts the sequential manipulation of the buttons into a selection criteria which is then transmitted to the effects unit to effect the selection of a pre-programmed or pre-selected effect. The timing of the sequencing of the two touch, or momentary switches may be adjusted in the software to suit the needs of the individual preforming artist.

7 Claims, 4 Drawing Sheets

CONTROLLER FOR A MUSICAL EFFECTS UNIT

The present invention relates to controllers for controlling a musical effects unit, and more particularly to a guitar mounted, two button command controller for an effects unit.

The use of electronics in the music field is commonly used to complement the mechanical production of music and in many cases is relied upon for the bulk of the music production activity. Musical artists who utilize a mechanical instrument still predominantly rely upon electronics both to amplify the mechanically produced sounds.

Further, musical artists also rely upon other types of electronic equipment to strongly affect the character and type of sound which is produced in the performance. Once such device is referred to as an effects device. The effects device is a sophisticated piece of equipment which allows the user to tailor and balance a set of characteristics to be applied to an input from a musical device. Many sound effects can be applied to the raw input from the instrument, the proper optimum combination of the sound effects being different for different performances of different songs.

The adjusting of the effects device to achieve the proper overall effect for a performance is a time consuming compositional task. Once the proper combination of input effects are found, such combination is digitized and stored in order to avoid both having to remember the particular combination, and to avoid having to multiply reset the controls to the effects unit.

During a single show, and when several songs are to be performed, the particular effect which was previously composed for each song needs to be quickly selected. The performer could walk over to the stack mounted controller and select the effect for the next song. However, since many music performances are stylish, extravagant shows intended to run non-stop, a break in the action would deleteriously effect the show. It would be most advantageous to enable the control of the effects at the instrument to avoid having to stop playing, and walk over to the effects equipment.

Some methods of control utilized in conjunction with instruments include U.S. Pat. Nos. 4,305,320; 4,184,400; 5,580,479; 4,702,141; 4,748,887; 4,777,857; 4,817,484; and 5,029,510. In many of the controls used in the above mentioned art, two categories predominate. In one category, the playing surfaces are used to activate electronic synthesizers, such that the instrument becomes the playing substrate itself. In another category, the instrument is utilized to produce the musical signal, while other electronics controlling the processing of the musical signal and where the electronics controlling such processing are controlled from the musical instrument.

These changes in the electronics controlling the processing have been via the use of knobs and selector switches mounted on the instrument, particularly a guitar. However, the artist must usually stop to look at the switch he is activating, either to assure its location among a series of other switches, or to obtain a visual indication of the selection he is making. For example, in the case of a rotary switch, it would be necessary to look at the knob to be able to ascertain to which position it was being actuated.

The necessity of stopping to look at a switch setting between performances may, at first blush not seem to be too onerous, but for many performances the shows are virtually continuous from start to finish, leaving little time between songs for a visual check and adjustment of the instrument. Further, and especially in the case of an effects unit, a single performance of a song may call for several different effects, each of which must be invoked in a timely fashion during the performance of the song. In this case, the performing artist has no time to visually check the position of a controller to ascertain its position.

Moreover, the environment of the performing stage does not ensure that there will be sufficient lighting for checking the position of a controller, even if there were time to do so. The lighting for the performing stage comes directly in at the performer, and varies widely in intensity over time. Such rapid and intense changes in light intensity makes it difficult to see, and may further inhibit the ability of the performer to ascertain the position of a switch, much like the temporary inability to see when driving resulting from exposure to an oncoming car's headlights.

On the other hand, incorporation of controls into the playing surfaces of the instrument takes up valuable playing space, or restricts the manner in which the instrument may be played without affecting the switch setting. For example, in a guitar switch in which the transverse position of the string against the fret is used to trigger an electronic device, part of the "playing space" is taken up, the particular manner of playing the string against the fret reserved for switchable control of the electronic device which the fret is set to operate.

A further problem with effecting control from the instrument is the placement of the controls. If the controls are positioned awkwardly, where they may be bumped or changed inadvertently, the effect will be de-selected, and the performance will be spoiled. Special attention must be given to the location of the selection controls with regard to the instrument playing area. Aside from the possibility of inadvertent actuation of the control switch, the playing of the instrument should not be interfered with by virtue of the location of any structure, especially control switches.

What is therefore needed is a method and device to allow an artist to rapidly select an effect from an effects unit. The method and device should preferably take up none of the available playing space nor playing variations while functioning as an effects selection mechanism. The method of selecting the desired effect should not require the artist to look at the instrument or other controller location as an indication of which effect is selected. The structure used to select the desired effect should be designed to prevent inadvertent actuation. The actuation method should further enable the performer to switchably select among a series of predetermined effects without stopping his musical performance. The desired actuation method should be easy to use, easy to learn, and quite reliable.

SUMMARY OF THE INVENTION

The controller for a musical effects unit of the present invention enables control of an effects unit through the use of two touch buttons mounted on a guitar, or other instrument. In the case of a guitar, the two buttons would preferably be located near the base portion of the guitar, and would be actuated by the performer's strumming hand. The two touch switches form an input to a microprocessor utilizing control software to interpret the sequential contacting of the buttons.

The software converts the sequential manipulation of the buttons into a selection criteria. The selection criteria is then transmitted to the effects unit to effect the selection of the preprogrammed, or preselected effect, which may include a multiplicity of separate effects characteristics combined into a single effect. The timing of the sequencing of the two touch, or momentary switches may be adjusted in the software to suit the needs of the individual performing artist.

BRIEF DESCRIPTION OF THE DRAWINGS

Other aspects, features and advantages of the invention, its configuration, construction, and operation will be best understood from the following detailed description, taken in conjunction with the accompanying drawings in which.

DETAILED DESCRIPTION OF THE PREFERRED EMBODIMENT

Figure 1:
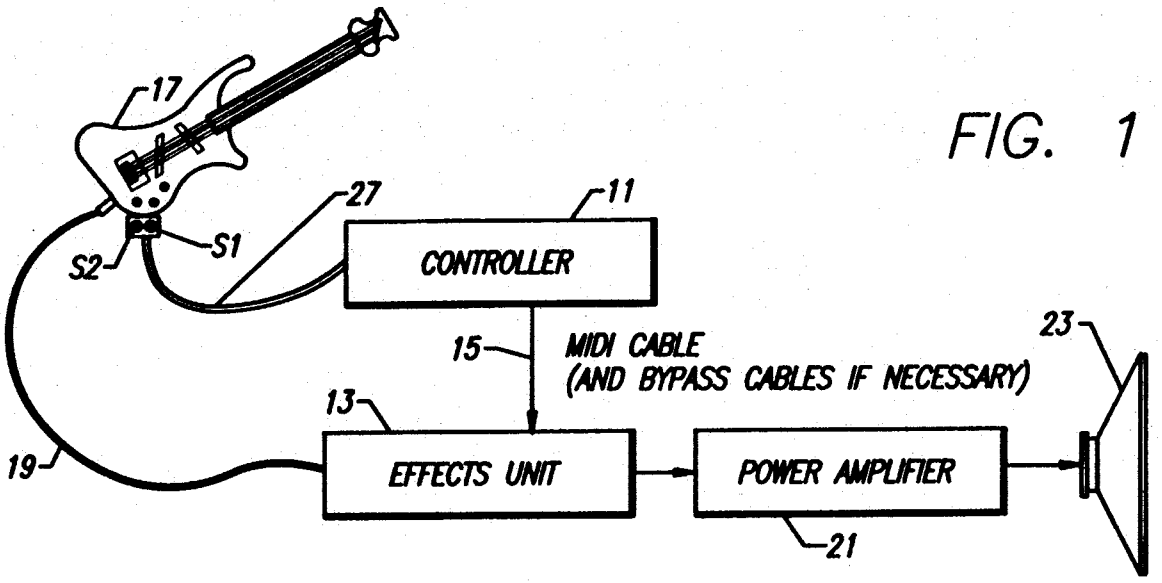
FIG. 1 is a view of the controller for a musical effects unit of the present invention shown in its operating environment.

Referring to FIG. 1, a controller 11 for a musical effects unit, as will be further described herein is connected to assist in the control of an effects unit 13. Effects unit 13 is essentially a signal processor. The connection from controller 11 to effects unit 13 will be a MIDI cable 15. MIDI is an acronym for Musical Instrument Digital Interface. MIDI is an international hardware and software interface standard. It was adopted by the manufacturers of electronic musical instruments and peripherals to facilitate communication between different types and brands of electronic musical devices. The MIDI Standard is utilized with synthesizers and electronic effects units like delays, equalizers, reverbs, distortion boxes, and the like.

Although the MIDI interface standard includes many types of messages and different commands, the invention herein is directly concerned with the Program Change message. Most digital music equipment has the ability to store many different settings, each representing a different way in which it is to affect the musical sound produced. The Program Change message is utilized according to the MIDI standard to select the desired setting. When a MIDI Program Change message is received by an electronic musical instrument or by an effects unit, the device changes its setting to the one specified by the newly received program number.

The controller 11 of FIG. 1 is utilized to generate the Program Change message, based upon inputs it receives from a performing artist. The specific method, logic and rationale with which a performing artist indicates that a change in program is to be made, and with which the controller 11 generates the associated Program Change messages is by the inventive device and method described herein.

In FIG. 1, completing a basic operating system, a guitar 17 is connected to the effects unit 13 by means of an audio input line 19. Audio input line 19 will be one or more coaxial transmission lines. It is understood that effects unit 13 may incorporate the functions of one or more of the following: amplifier, equalizer, preamplifier, effects, delays, reverbs, and so forth.

Typically, the effects unit 13 output will be connected to a power amplifier 21 through appropriate connection lines, and the power amplifier 21 will be connected to one or more speakers 23. Near the bottom of guitar 17 are located two switches S1 and S2. The switches may either be mounted externally to the guitar 17, or they may be permanently mounted in the guitar body. The switches should be mounted somewhat close to where the volume and tone controls of the guitar are located. The switches S1 and S2 are momentary switches and are connected with appropriate wiring 27 to the controller 11. The connection of switches S1 and S2 is preferably accomplished with a three wire line 27 because three wires are the minimum number of wires needed to electrically connect to switches to the controller. As will be shown in great detail, the controller 11 of the present invention enables the manipulation of the switches S1 and S2 to control the effects unit 13 according to a predetermined and user adjustable format.

Figure 2:
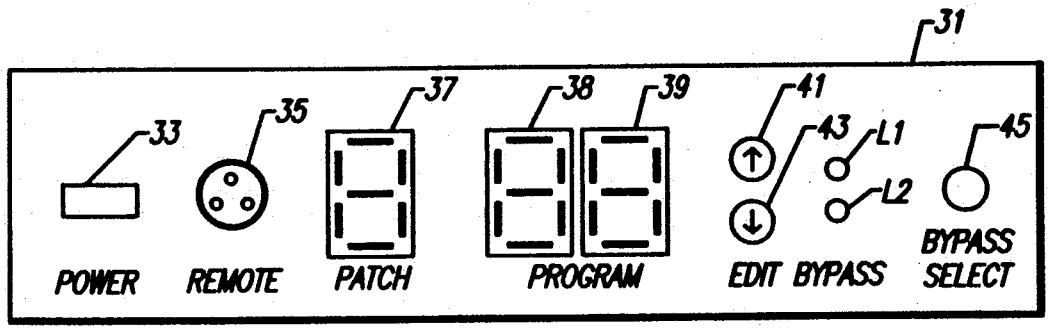
FIG. 2 is a front view of one possible configuration of the controller for a musical effects unit of the present invention illustrating the inputs and outputs available to a user.

Referring to FIG. 2, one possible layout for a panel 31 of the controller 11 is illustrated. It is understood that a variety of other layout schemes may be utilized, but that this is thought to be the preferred layout for optimum user utility. Beginning at the far left side of the panel is a main power switch 33. Adjacent the main power switch 33 is a three pin connector 35. The three pin connector 35 is a female connector which accepts a comparable male connector (not shown) attached to wiring 27 (of FIG. 1) to facilitate the connection of wiring 27 into the controller 11.

Adjacent the three pin connector 35 is a current patch display 37. Current patch display is a preferably a seven segment LED-type display capable of displaying all 10 numerical digits, as well as many letters of the alphabet, such as A, b, C, d, E, F, g, h, I, J, L, and P. The seven segment led was chosen for simplicity, and because for the two switch implementation, it has the capability to display a reasonable number of two switch combination manipulations. Indeed, the method and device of the instant invention is most certainly expandable to three or more switches which are functional as the switches S1 and S2 function. And it is most certainly comprehended that the current patch display 37 may be two seven segment led-type indicators, or any other display, irrespective of the complexity, such as a dot matrix display capable of illustrating all numbers as well as a variety of different types of letters.

Adjacent the current patch display 37 is a pair of MIDI program number displays 38 and 39. The MIDI program number displays 38 and 39 is preferably a pair of seven segment LED-type displays, each similar to those which were described for the current patch display 37. Again, it is most certainly comprehended that the MIDI program number displays 38 and 39 may be any type of display, irrespective of the complexity, such as a dot matrix display capable of illustrating all numbers as well as a variety of different types of letters.

To the right of the MIDI program number displays 38 and 39 is a pair of edit switches, namely an upper edit switch 41 and a lower edit switch 43. Adjacent the edit switches 41 and 43 are a pair of bypass indicator lights, namely bypass indicator light L1 and bypass indicator light L2. Adjacent the bypass indicator lights L1 and L2 is a bypass select switch 45. Bypass select switch 45 selects one or both of the bypass channels, according to a table, namely Table II, to be discussed below.

Figure 3:
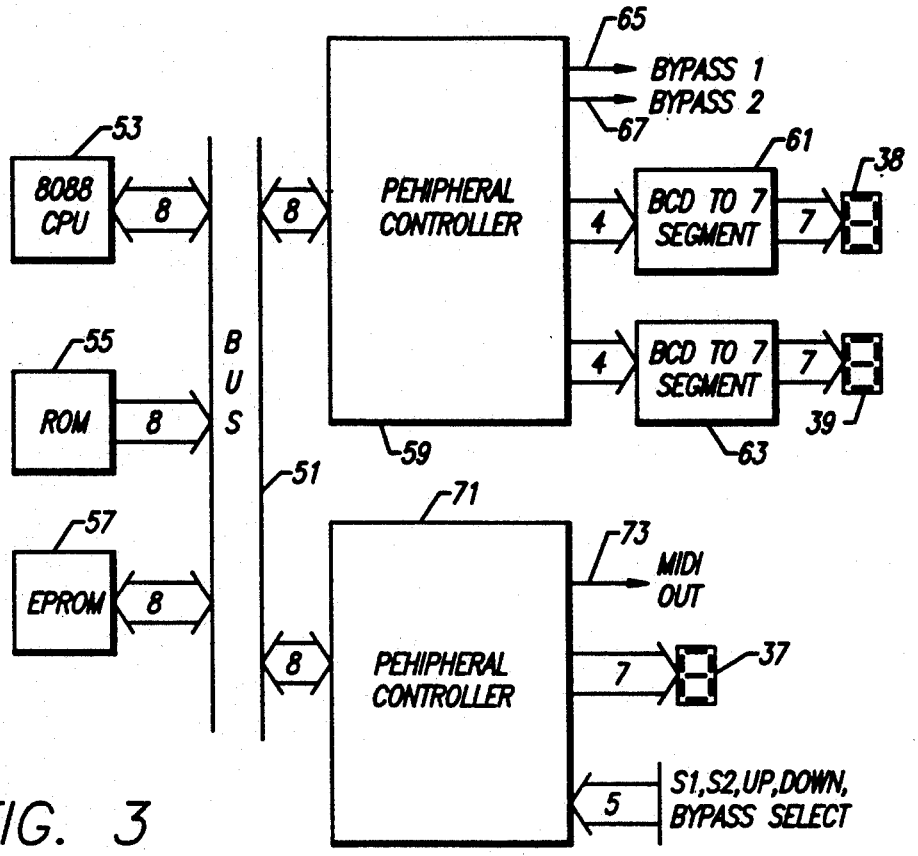
FIG. 3 is a system diagram illustrating the structure of the system in which the controller for a musical effects unit of the present invention operates.

Referring to FIG. 3, a block diagram of the system architecture embodied within the circuitry of controller 11 is illustrated. A data bus 51 is the main channel of communication within the controller 11. Data bus 51 is preferably an eight bit bus, and the devices in communication with the data bus 51 will communicate in an eight bit manner. Data bus 51 is in parallel communication with a central processing unit 53. Preferably the central processing unit 53 will be an 8088 microprocessor. A ROM 55 is also connected into the data bus 51, as is an EEPROM 57.

A first peripheral controller 59 is also connected to and in communication with data bus 51. First peripheral controller 59 is preferably an 8255 peripheral controller having 24 bits of input/output capability. First peripheral controller 59 is also connectably in communication with a first and second binary coded decimal to seven segment display converters 61 and 63. First peripheral controller 59 communicates with each of the first and second binary coded decimal to seven segment display converters 61 and 63 with a four bit connection. Four bits are sufficient to enable $2^4$, or 16 different values to be transmitted to each of the first and second binary coded decimal to seven segment display converters 61 and 63, however, the instant embodiment needs only 10 different values for each of the converters 61 and 63 in order to display a two place value of 100 selections, namely 00 through 99.

First and second binary coded decimal to seven segment display converters 61 and 63 are connected to MIDI program number displays 38 and 39, respectively. MIDI program number displays 38 and 39 were previously illustrated in FIG. 2. The connection from first and second binary coded decimal to seven segment display converters 61 and 63 to MIDI program number displays 38 and 39 is accomplished with a seven bit connection, since there are seven possible segments to be illuminated. Also connected to the first peripheral controller 59 is a bypass output 65 and a bypass output 67. The bypass outputs 65 and 67 are also connected to both the bypass indicator lights L1 and L2, and a pair of bypass outputs to be discussed in greater detail below.

A second peripheral controller 71 is also connected to and in communication with data bus 51. Second peripheral controller 71 is similar to first peripheral controller 59. Second peripheral controller 71 is connected to current patch display 37, as was shown in FIG. 2. The current patch display 37 is a seven segment display, and has seven bits, or lines of connection with the second peripheral controller 71. A binary coded decimal to seven segment display converter is not used because the current patch display 37 must display alphanumeric characters instead of digits. Binary coded decimal to seven segment display converters can only display digits, so each segment of the display must be directly connected to the computer so that the computer itself can generate the alphanumeric characters.

Second peripheral controller 71 also has an input which communicates with switches S1 and S2 of FIG. 1, upper edit switch 41, lower edit switch 43, and bypass select switch 45. Second peripheral controller 71 has a midi output 73. MIDI output 73 should be a five wire grounded connection utilizing a connector having a semicircular arrangement of connector pins. MIDI output 73 will be connected to effects unit 13, which may be, as previously discussed, a wide range of types of effects unit. MIDI output 73, is the port through which the MIDI based command is sent to the effects unit 13 telling it which setting or combination of settings are to be invoked.

Figure 4:
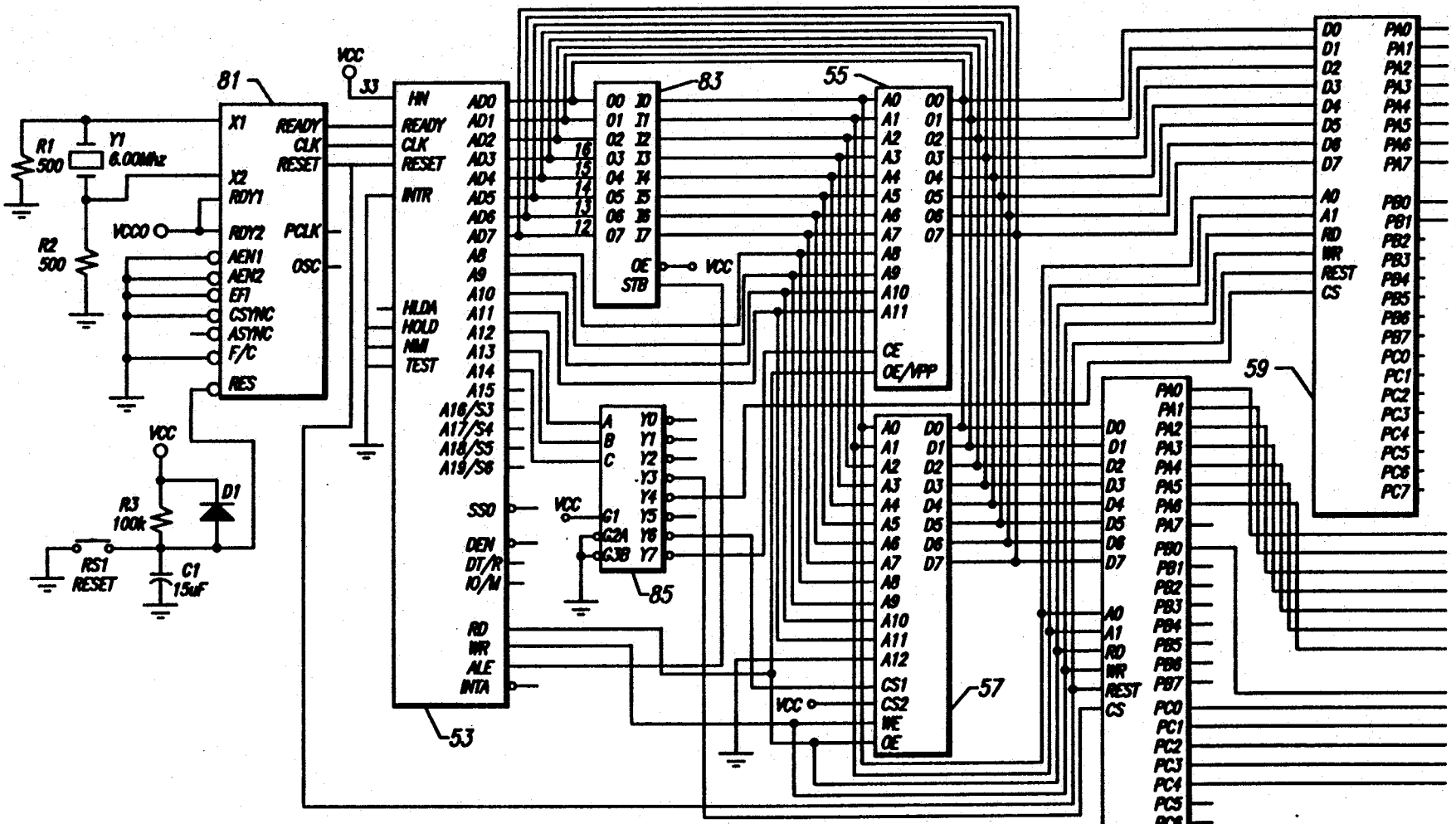
FIG. 4 includes sheets 4(1) and 4(2) is a schematic flow diagram illustrating one possible programming configuration for utilization with the controller for a musical effects unit of the present invention.
Figure 4:
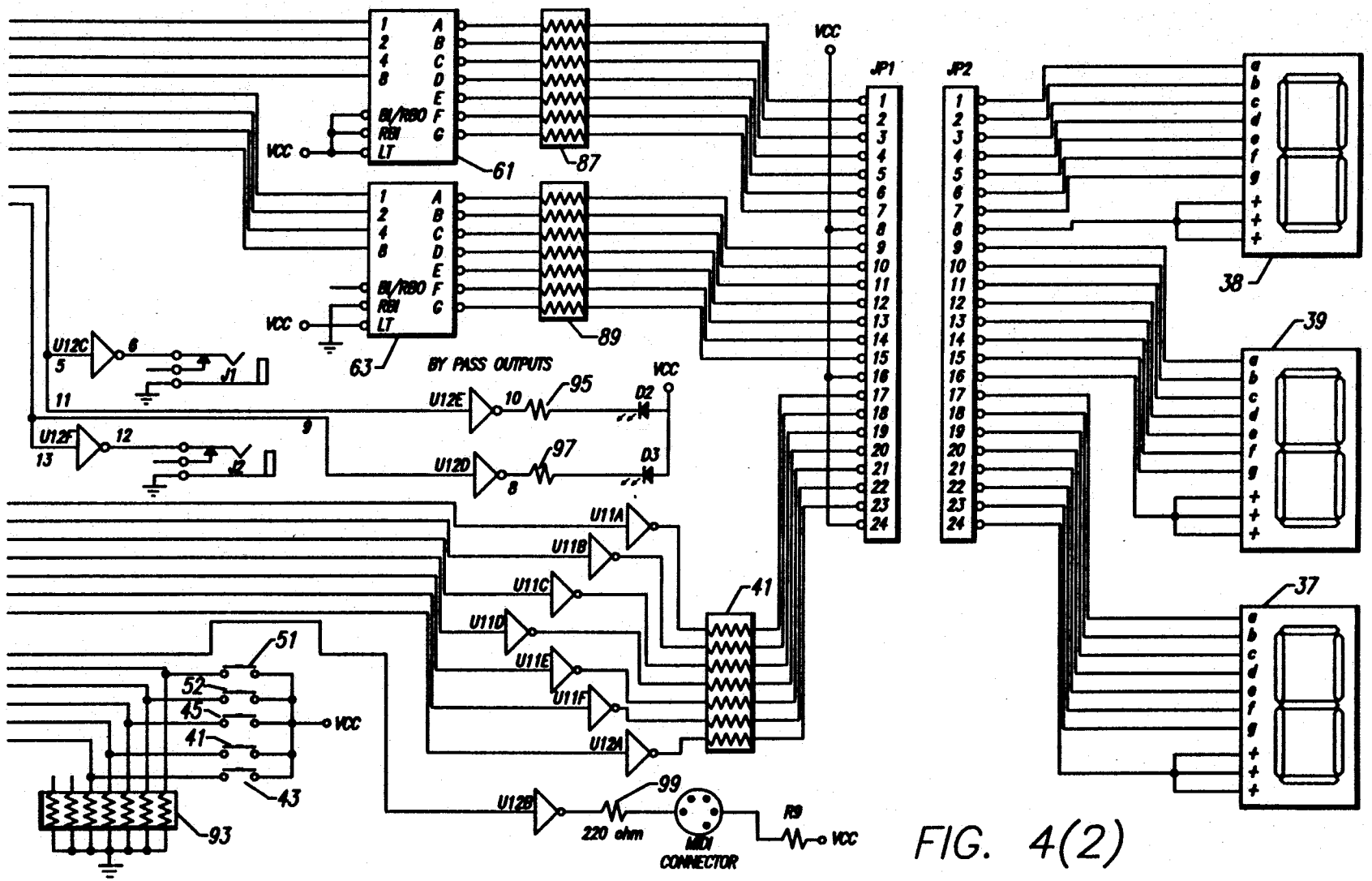

Referring to FIG. 4, a detailed schematic of the circuitry of the instant invention is illustrated. A clock generator 8 is utilized to provide timing signals for the other circuitry in the invention. A 6.0 megahertz crystal Y1 is connected in parallel between the X1 and X2 inputs of the clock generator 81. Input X1 is grounded through a 500 ohm resistor R1 and input X2 is grounded through a 500 ohm resistor R2. The Voltage supply VCC, which is nominally 5.0 volts positive, is connected into inputs RDY1 and RDY2 of clock generator 81. The inputs AEN1, AEN2, EFI, CSYNC, ASYNC, and F/C are appropriately grounded.

The reset terminal RES is connected to a small reset circuit, including the cathode of a diode D1, one end of a resistor R3, and one end of a capacitor C1. The other ends of resistor R3 and Diode D1 are connected to the positive voltage supply VCC. The other end of the capacitor C1 is grounded. This reset circuit provides a reset signal upon powerup. The reset terminal RES is also connected to one end of a reset switch RS1, while the other end reset switch RS1 is grounded.

The READY, CLK, and RESET outputs of clock generator 81 are connected to similarly labeled inputs of central processing unit 5 which was shown in FIG. 3. The MN input of central processing unit 53 is connected to the power supply VCC, while the inputs HLDA, HOLD, NMI, and TEST are appropriately grounded. The outputs of the central processing unit utilized further along in the circuitry include AD0, AD1, AD2, AD3, AD4, AD5, AD6, AD7, A8, A9, A10, A11, A12, A13, A14, RD, WR, and ALE. The AD0, AD1, AD2, AD3, AD4, AD5, AD6, and AD7 outputs of the central processing unit 53 are made available to the 00, 01, 02, 03, 04, 05, 06, and 07 inputs of an octal latch 83, and to the 00, 01, 02, 03, 04, 05, 06, and 07 outputs of ROM 55, and the D0, D1, D2, D3, D4, D5, D6, and D7 outputs of EEPROM 57.

The octal latch 83 has outputs 0, I1, I2, I3, I4, I5, I6, and I7 which are connected to the A0, A1, A2, A3, A4, A5, A6, and A7 inputs of the ROM 55 and of the EEPROM 57. The OE input of octal latch 83 is connected to the power supply VCC, while a STB input of octal latch 83 is connected to the ALE output of central processing unit 53.

A decoder 85 accepts inputs A, B, and C from outputs A12, A13, and A14 of central processing unit 53. terminal G1 of decoder 85 is connected to the power supply VCC, while terminals G2A and G2B are connected to ground. Decoder 85 has outputs Y3, Y4, Y6 and Y7 which are further utilized.

ROM 55 has inputs A8, A9, A10, and All which are connected to the outputs A8, A9, A10, and A11 of central processing unit 53. ROM 55 has an input CE which is connected to output Y7 of decoder 85, and an input OE/VPP which is connected to output RD of central processing unit 53. ROM 55 has outputs 00, 01, 02, 03, 04, 05, 06, and 07.

EEPROM 57 has inputs A0, A1, A2, A3, A4, A5, A6, A7, A8, A9, A10, and A11 which are connected in parallel to inputs A0, A1, A2, A3, A4, A5, A6, A7, A8, A9, A10, and A11 of ROM 55. EEPROM 57 has an input CS1 connected to output Y6 of decoder 85. EEPROM 57 has an input CS2 connected to power supply VCC. EEPROM 57 also has an input WE connected to terminal WR of central processing unit 53, and an input OE connected both to terminal OE/VPP of ROM 55 and to terminal RD of central processing unit 53. EEPROM 57 has outputs D0, D1, D2, D3, D4, D5, D6, and D7 which are connected in parallel with the outputs 00, 01, 02, 03, 04, 05, 06, and 07 of ROM 55, and are made available to the inputs D0, D1, D2, D3, D4, D5, D6, and D7 outputs of the peripheral controllers 59 and 71.

The RD inputs of peripheral controllers 59 and 71 are both connected to the OE and OE/VPP terminals of EEPROM 57 and ROM 55, respectively. The WR terminals of peripheral controllers 59 and 71 are both connected to the WE terminal of EEPROM 57 and the WR terminal of central processing unit 53. The A0 inputs of peripheral controllers 59 and 71 are both connected to the A0 terminals of EEPROM 57 and ROM 55. The A1 inputs of peripheral controllers 59 and 71 are both connected to the A1 terminals of EEPROM 57 and ROM 55. The RESET terminals of peripheral controllers 59 and 71 are both connected to the RESET terminals of central processing unit 53 and clock generator 81. The CS terminals of peripheral controllers 59 and 71 are both connected to Y4 and Y3 of decoder 85 respectively.

Peripheral controller 59 has its output terminals PA0, PA1, PA2, and PA3 connected to the input terminals 1, 2, 4, and 8 of first binary coded decimal to seven segment display converter 61. Peripheral controller 59 also has its output terminals, PA4, PA5, PA6 and PA7 connected tot he input terminals 1, 2, 4, and 8 of the secondary binary coded decimal to seven segment display converter 63. First and second binary coded decimal to seven segment display converters 61 and 63 each have outputs A, B, C, D, E, F, G, which are connected through an associated one of their matched resistor banks 87 and 89, respectively. Matched resistor banks 87 and 89 have resistive elements having a nominal resistance of 220 ohms. The outputs of the matched resistor banks 87 and 89 are connected to terminals 1-7 and 9-17 of a 24 pin dual in line package JP1. The pins 8, 16, and 24 of dual in line package JP1 are connected to VCC.

Peripheral controller 71 has its output terminals PA0, PA1, PA2, and PA3 connected to a series of inverter amplifiers U11A, U11B, U11C, U11D, U11E, U11F, U11G, and U11H. The inverting amplifiers are necessary because peripheral controller 71 cannot supply the current necessary to drive the seven segment display. The outputs of the inverter amplifiers U11A, U11B, U11C, U11D, U11E, U11F, U11G, and U11H are connected to a matched resistor bank 91. The output of matched resistor bank 91, in which resistors have a nominal resistance of 220 ohms, is connected to terminals 17-23 of dual inline package JP1.

Switch inputs to second peripheral controller 71 are provided by terminals PC0, PC1, PC2, PC3, and PC4. Terminals PC0, PC1, PC2, PC3, and PC4 are connected to ground through a 5000 ohm matched resistor bank 93. Switch S1 switches the 5 volt power supply VCC into contact with terminal PC0. Likewise, switch S1 switches the 5 volt power supply VCC into contact with terminal PC1. Bypass select switch 45 switches the 5 volt power supply VCC into contact with terminal PC2. The upper and lower edit switches 41 and 43 switch the 5 volt power supply VCC into contact with terminals PC3, and PC4, respectively.

Output PB0 of first peripheral controller 59 forms the first bypass output. A jack J1 is used to connect the bypass output through an inverting amplifier U12C, which is, in turn connected to output PB0 of first peripheral controller 59. Another inverting amplifier U12E has an input connected to output PB0, and an output connected to first bypass indicator light L1 through a resistor 93. Similarly output PB1 of first peripheral controller 59 forms the second bypass output. A jack J2 is used to connect the bypass output through an inverting amplifier U12F, which is, in turn connected to output PB1 of first peripheral controller 59. Another inverting amplifier U12D has an input connected to output PB1, and an output connected to second bypass indicator light L2 through a resistor 97.

Output PB0 of second peripheral controller 71 forms the MIDI based command output. An inverting amplifier U12B has an input connected to output PB0, and an output connected to a 220 ohm resistor 99 which then goes to pin 5 of the MIDI output connector. Pin 4 of the MIDI output connector is connected through resistor R9 to VCC. This is to provide the power required to drive the optoisolator at the receiving end of the MIDI cable. The MIDI standard uses optoisolators to avoid possible ground loops associated with direct connections.

A 24 pin dual in line package 101 is utilized as an output connector for current patch display 37 and MIDI program number displays 38 and 39.

The operation of the controller for a musical effects unit of the present invention is accomplished by manipulation of the switches S1 and S2 shown in FIGS. 1-5. The performing artist presses one or more of the switches in a one or two cycle sequence to recall one of 12 patch positions. Before manipulation of the switches, the performing artist programs the unit to associate one or more of the 12 patch positions with a program number. The program number is usually either pre selectable in a given commercially available effects unit 13, or is created within an effects unit 13, and stored under or within a given program number. The controller 11 of the present invention is preprogrammed by the artist to associate a patch identifier with a program number. The performing artist knows that the selection of a patch designator will cause the controller 11 to select a program number and command the effects unit 13 to be set to that program number.

The patch designations which are logically registrable on a seven segment LED include A, b, C, d, E, F, g, h, I, J, L, and P. Each patch is associated with a sequence of manipulations of switches S1 and S2. Table I includes a preferred listing of the manipulations with their associated patch designators.

TABLE I

| Combination | Patch Number |
|---|---|
| S1 once | A |
| S2 once | b |
| Both once | C |
| S1 twice | d |
| S2 twice | E |
| S1 then S2 | F |
| S2 then S1 | g |

TABLE I-continued

| Combination | Patch Number |
|---|---|
| Both then S1 | h |
| Both then S2 | I |
| S1 then Both | J |
| S2 then Both | L |
| Both twice | P |

The switches S1 and S2 are physically manipulated somewhat like the buttons on a computer mouse. Each can be either single clicked or double clicked. When one or more of the switches S1 and S2 are manipulated, the controller for a musical effects unit of the present invention recalls a patch, and the actual program number associated with the patch is sent out from the controller 11 to the effects unit 13.

In programming, or associating a patch designator with a program number, the program number for the currently selected patch is modified by using the upper and lower edit switches 41 and 43. Upper edit switch 41 increments the program number by one, while the lower edit switch 43 decrements the program number by one. If one of the upper or lower edit switches 41 and 43 are held down for a short time, they will either increment or decrement at a constant rate. This is the familiar auto-repeat function.

The bypass jacks are actually separate switches to control other separate, non-MIDI based effects units 13. Such non-MIDI based pieces of equipment are turned on or off with a ¼" two conductor jack acting as a switch. In this manner, an older, or more specialized piece of effects equipment, not capable of receiving a MIDI based command, can be invoked with a simple turn on, or turn off signal. An open circuit indicates that the device is to be turned on, while a short circuit indicates that it is to be turned off.

The bypass select switch 45 is a contact switch which cycles through four states. The four states, for the two bypass outputs, include all combinations of on and off, and are set forth below in Table II.

TABLE II

| BYPASS SWITCH STATES | | |
|---|---|---|
| Bypass select switch position | Bypass 1 | Bypass 2 |
| 1 | off | off |
| 2 | on | off |
| 3 | off | on |
| 4 | on | on |

As will be shown, the software responsible for operating the controller 11 shown in the Figures takes care of the timing with which manipulation of the switches S1 and S2 is allowed. In this manner, the speed of manipulation of the switches S1 and S2 may be adjusted to suit the needs of the individual performing artist.

Figure 5:
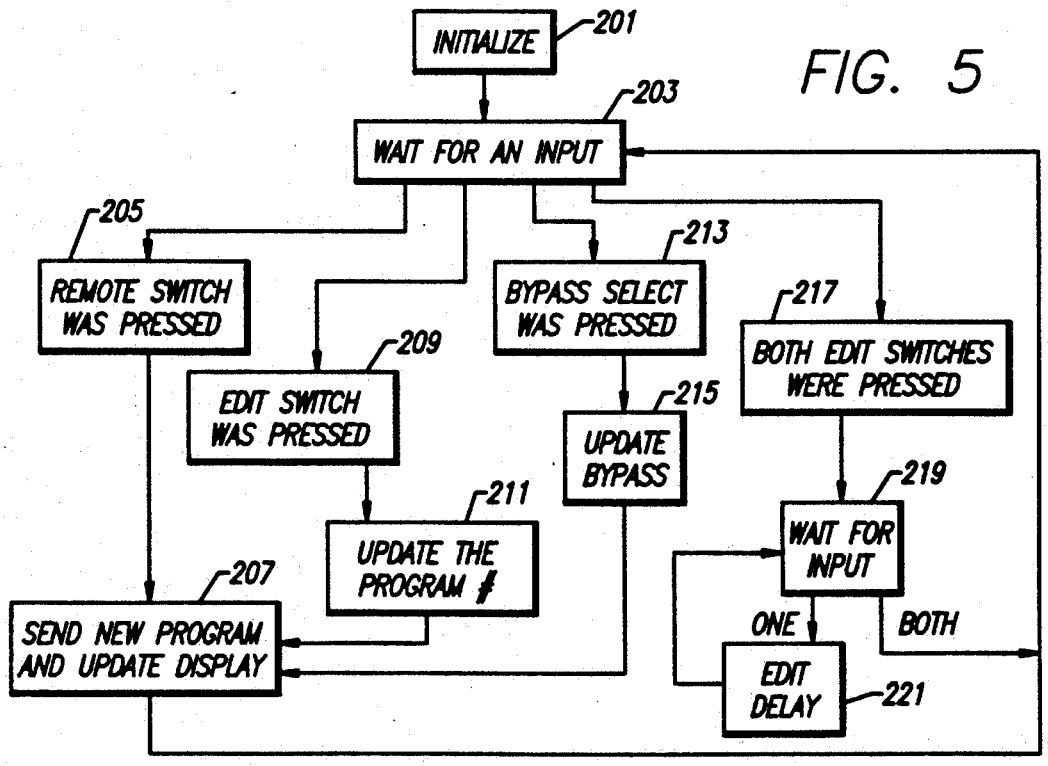
FIG. 5 is a detailed schematic of the circuitry for the controller for a musical effects unit of the present invention.

Referring to FIG. 5, a flow chart outlining one possible programming logic to perform the operation of the controller 11 of the present invention is illustrated. An initialize block 201 is caused to be the first logic block addressed upon the powering up of the system. From the initialize block 201, the logic flows to the "Wait for an input" block 203. From the "Wait for an input" block 205, the logic requires an external event to occur before the logic flows elsewhere.

In the event that a remote switch, namely S1 or S2 is pressed, the logic flows through a "Remote switch was pressed" block 205 and then to a "Send new program and update display" block 207, which causes another program number to be sent to the effects unit 13, and updates the MIDI program number displays 38 and 39. The logic then flows back to the "Wait for an Input" block 203.

In the event that the edit switch, namely the upper or lower edit switches 41 or 43 were pressed, the logic flows through an "Edit switch was pressed" block 209 and then to an "update the program number" block 211, which causes another program number to be associated with a given patch designator. The logic then returns again to the "Send new program and update display" block 207, which causes another program number to be sent to the effects unit 13, and updates the MIDI program number displays 38 and 39. The logic then flows back to the "Wait for an Input" block 203.

In the event that the bypass select switch 45 is pressed, the logic flows through an "Bypass Select was pressed" block 213 and then to an "update bypass" block 215, which causes the bypass state described in Table II to change. The logic then returns again to the "Send new program and update display" block 207, which causes another program number to be sent to the effects unit 13, and updates the MIDI program number displays 38 and 39. The logic then flows back to the "Wait for an Input" block 203.

Finally in the event that both the upper and lower edit switches 41 and 43 are simultaneously pressed, the logic flows through a "Both Edit switch were pressed" block 217 and then to a "Wait for input" block 219. This is the "double click delay edit mode" which allows the user to modify the response time allowed for a double click. From the "Wait for input" block 219, a further single press of one of the upper or lower edit switches 41 or 43 causes the logic to flow to an "Edit delay" block 221 which will either increment or decrement the value of the double click delay, depending on which edit button was pressed. The logic flows back to the "Wait for input" block 219. Also from the "Wait for input" block 219, a further double press of both the upper and lower edit switches 41 and 43 causes the logic to flow back to the "Wait for an input" block 203 thus exiting the "double click delay edit mode".

It is understood that the invention and logic herein is basic as it relates to a pair of switches S1 and S2. A single switch could be utilized with any of a series of communication rationales. For example, the controller 11 could be programmed to utilize a single switch S1 to be tapped multiple times to indicate the identity of the patch desired. If the operator wanted to use morse code, the controller 11 could be programmed to interpret morse code, and a patch could thereby be directly selected. Alternately, and following the two switch rationale, three or more switches like S1 and S2 could be utilized, with the accompanying logical expansion of the truth table I.

Although the invention has been described with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

A computer printout of the source code of one possible program in which the controller 11 of the present may be programmed is set forth upon the following pages. The language utilized is the assembly language, and appropriate comments are listed along side the assembly language program. The program handles the timing which enables the controller to distinguish between a single click and a double click. For example, when the user presses a switch (either S1, S2 or both), the program starts an internal timer the instant that the switch is released. If the user activates a switch before the timer expires, the action is recognized as a double click. If no switch is pressed within this period, the action is recognized as a single click. The length of the time delay can be modified by the user by entering the "double click delay edit mode". This allows the device to be customized to the touch of the individual. Some people will tend to have a faster double click than others will, and the controller needs to accommodate that.

What is claimed is:

1. A control system for a musical instrument comprising:

contact switch means, for manual momentary closure by an operator;

a controller means, having an electrical input connected to said switch means and an electrical output, for detecting said closure of said switch means and for generating a program selection signal, and wherein said controller means further comprises:

a central processing unit;

a first peripheral controller electrically connected to said central processing unit and to said contact switch means;

a second peripheral controller electrically connected to said first peripheral controller and said central processing unit;

a ROM electrically connected to said first and second peripheral controllers and said central processing unit;

an EEPROM electrically connected to said ROM said first and second peripheral controllers and said central processing unit;

visual indicator means, connected to said first and second peripheral controllers, for providing a visual readout of a status of said controller means; and an effects unit, having an electrical input connected to said electrical output of said controller means, an audio musical signal input and an audio musical signal output.

2. The control system for use with a musical instrument as recited in claim 1 wherein said visual indicator means further comprises:

a first binary coded decimal to seven segment converter electrically connected to said first peripheral controller;

a second binary coded decimal to seven segment converter electrically connected to said first peripheral controller;

a first seven segment light indicator electrically connected to said first binary coded decimal to seven segment converter;

a second seven segment light indicator electrically connected to said second binary coded decimal to seven segment converter; and a third seven segment light indicator electrically connected to said second peripheral controller.

3. The control system for use with a musical instrument as recited in claim 2 wherein said ROM is programmed to convert a sequenced closure of said switch means into a program command signal.

4. The control system for use with a musical instrument as recited in claim 2 wherein said ROM which is programmed to convert a sequenced closure of said switch means into a program command signal, is programmed to adjust the timing at which said sequenced closure of said switch means is permitted to be received.

5. A control system for a musical instrument comprising:

contact switch means, for manual momentary closure by an operator;

controller means, having an electrical input connected to said switch means and an electrical output, for detecting said closure of said switch means and for generating a program selection signal;

an effects unit, having an electrical input connected to said electrical output of said controller means, an audio musical signal input and an audio musical signal output; and a musical instrument having an audio musical output connected to said audio musical signal input of said effects unit, said switch means mounted on said musical instrument.

6. A process of controlling an effects unit having an audio input and an audio output from a point on a musical instrument comprising the steps of:

providing a programmed controller having a patch display for indicating a patch designation which is programmed to interpret a predetermined sequence of the closing of at least one momentary contact switch;

programmably assigning a program number to said patch designation, said program number to be transmitted to said effects unit;

providing a musical instrument having at least one momentary contact switch mounted thereon connected to said programmed controller; and actuating at least one momentary contact switch according to a predetermined sequence associated with a patch designation to select said patch designation and cause said program number to be transmitted to said effects unit.

7. The process of controlling an effects unit from a point on a musical instrument as recited in claim 6 wherein said program number is transmitted to an effects unit in MIDI format.

* * * * *